US005132644A

United States Patent [19]

Knorr

[11] Patent Number: 5,132,644

[45] Date of Patent: Jul. 21, 1992

[54] MICROWAVE CAVITY SWITCH

[76] Inventor: Siegfried G. Knorr, 1132 Chantilly Rd., Los Angeles, Calif. 90024

[21] Appl. No.: 537,415

[22] Filed: Jun. 13, 1990

[51] Int. Cl.[5] ..... H01P 1/12

[52] U.S. Cl. ..... 333/105; 333/246; 333/262

[58] Field of Search ..... 333/105, 108, 246, 258, 333/262; 200/504; 335/4, 5

[56] References Cited

U.S. PATENT DOCUMENTS

| | | | |
|---|---|---|---|
| 2,576,943 | 12/1951 | Jenks | 333/258 X |
| 2,951,218 | 8/1960 | Arditi | 333/116 |
| 3,600,542 | 8/1971 | Richter | 200/504 X |
| 4,595,893 | 6/1986 | Charbonnier et al. | 333/105 X |
| 4,782,313 | 11/1988 | Brant, Jr. | 333/262 X |

*Primary Examiner*—Paul Gensler
*Attorney, Agent, or Firm*—Robert A. Seldon

[57] ABSTRACT

A microstrip switch having a conductive path comprises a grounded waveguide cavity-defining enclosure. A movable switch member having first and second, separated, electrically conductive segments is mounted within a path-interrupting gap for movement between an open position and a closed position. The first conductive segment is always electrically coupled to the cavity enclosure. The second conductive segment comprises a cantilevered, springy member for contact with the conductive path on either side of the gap when the switch is closed. Single-throw and double-throw embodiments are described.

21 Claims, 3 Drawing Sheets

FIG. 1 PRIOR ART
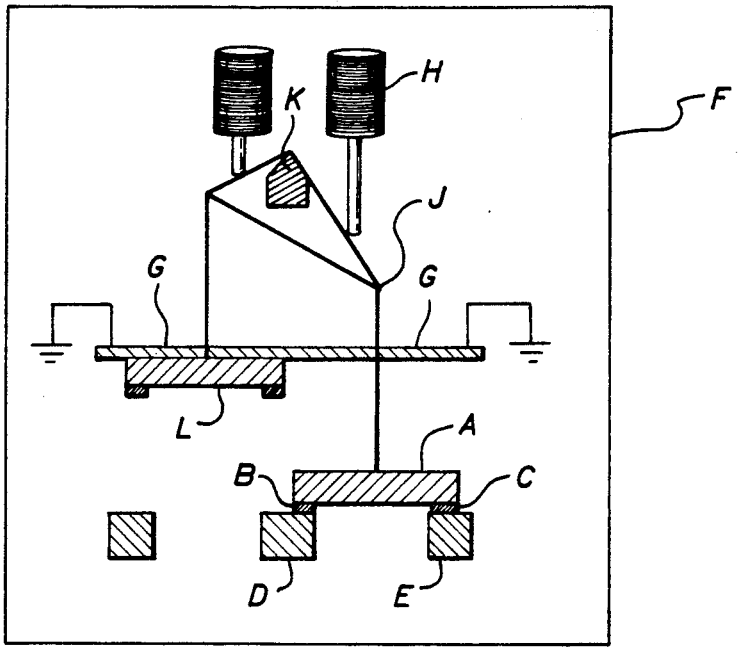
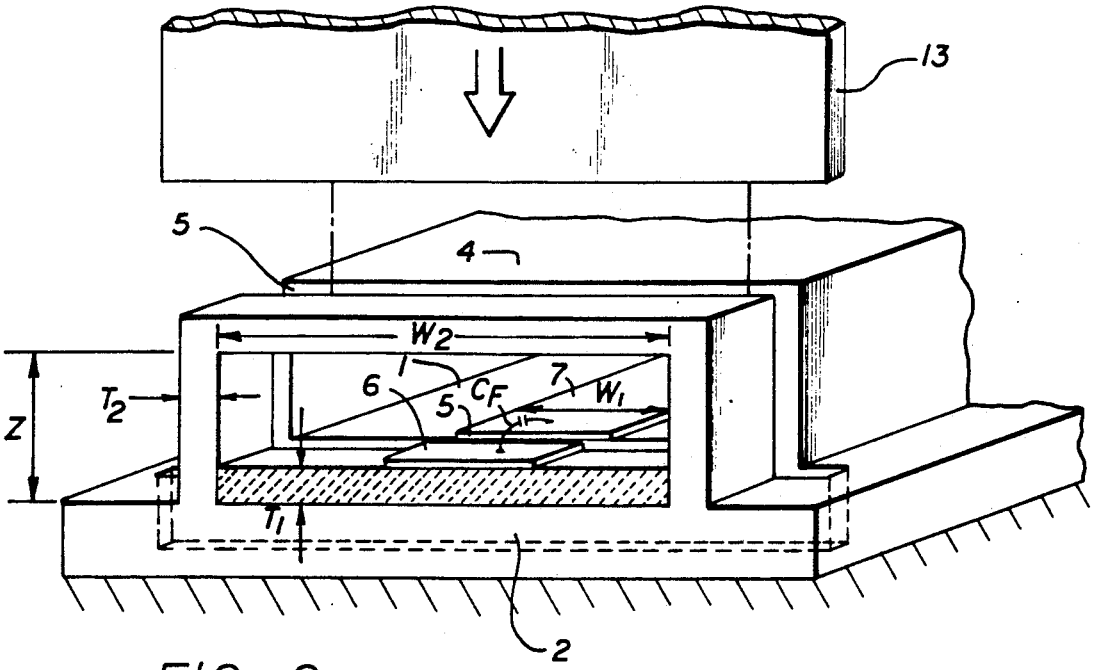
FIG. 2

MICROWAVE CAVITY SWITCH

BACKGROUND OF THE INVENTION

This invention relates to the general area of mechanical microwave switches, often referred to as "coaxial switches" or "coaxial relays".

Microwave switches are designed to accommodate signals ranging in frequency from 0 Hz (i.e., d.c.) to above 40 GHz. Unlike general purpose mechanical switches and relays, microwave switches must maintain an essentially constant impedance over a broad range of frequencies so that the signal characteristics are not affected by the switch.

There are three generally recognized, critical requirements for microwave switches. First, there should ideally be no losses of the signal passing through the switch when the switch is closed. A measure for specifying the losses is defined as "Insertion Loss", and is usually expressed in dB as a function of frequency. Second, no signal should pass through the switch, ideally, when the switch is open. A measure for quantifying this characteristic is called "Isolation" and is also typically expressed in dB as a function of frequency. Third, the parameter quantifying the quality of maintaining a constant characteristic impedance as a function of frequency is usually referred to as "Return Loss" and is also typically stated in dB.

Of the three parameters identified above, the provision of an optimal "Isolation" characteristic is particularly difficult at microwave frequencies. The reason for the difficulty is that even the smallest amount of capacitance between the open switch contacts will quickly deteriorate the isolation between the input and output terminals as frequency increases.

BRIEF DESCRIPTION OF THE PRIOR ART

Currently available mechanical microwave switches generally fall into one of two categories. The first type, illustrated in FIG. 1, comprises a thick metal bar "A" having contacts "B","C" which is moved up or down to respectively close or open the switch by making or breaking contact with stationery contacts "D","E" connected to the switch's input and output terminals. The metal bar "A" is contained within a grounded metal cavity "F" having critical dimensions which determine the characteristic impedance of the switch for both the "open" and "closed" states. When the switch is in the "open" position, the bar "A" is grounded by contacting surfaces "G" affixed to the metal cavity, to thereby improve the isolation characteristics of the switch. The bar "A" is moved up and down by a solenoid "H", acting on a pivot arm "J" which pivots about a point "K" to move the metal bar "A". Typically, a second similar metal bar "L" is mounted on the other end of the pivot arm "J" to cooperatively yield a single-pole, double-throw function.

A second type of microwave switch which is presently available comprises a very thin metal strip positioned very close to a grounded housing, and is generally referred to as an "edge-coupled line" switch Although it usually offers higher performance characteristics than the first-described type of switch, it requires very critical dimensions and tolerances.

For both of the previously described switches, impedance is primarily determined by (1) the dielectric constant of the media separating the input and output contacts (typically "air", which has a dielectric constant close to unity), (2) the physical dimensions of the metal bar and (3) the critical cavity dimensions.

In both cases, presently available microwave switches (or relays) require very precise mechanical machining of parts, and careful assembly procedures. Consequently, there is a high manufacturing cost associated with such switches. In addition, a substantial amount of power (typically 3 watts) is required to actuate the switch. Most switches include expensive microwave connectors adapted to couple to coaxial cables, and cannot be conveniently mounted on printed circuit board because of their relatively large size and non-removable connectors. Although some companies have recently offered pc-mountable microwave switches, their performance characteristics have been compromised by the elimination of the coaxial connectors.

SUMMARY OF THE INVENTION

A microwave switch is disclosed herein which comprises a grounded waveguide cavity-defining enclosure. An electrically conductive path of material is provided within the waveguide cavity and extends between the input and output terminals of the switch. A path-interrupting gap is formed in the material at some place between the input and output terminals. A movable switch member is mounted within the gap for movement between an "open" position which open-circuits the switch and a "closed" position during which the switch is closed.

The switch member comprises a first electrically conductive segment which is electrically connected to the grounded enclosure and positionable within the gap when the switch is "open" to interrupt any capacitive coupling field otherwise bridging the gap. Electrically conductive means, preferably mounted on the switch member and separated from the first electrically conductive segment by electrically non-conductive material, establishes a conductive path across the gap when the switch is "closed" The member can be moved between the open and closed positions by any means, including but not limited to a solenoid.

Additional details and information concerning the invention will be appreciated from the following Description of the Preferred Embodiment, of which the drawing is a part.

BRIEF DESCRIPTION OF THE DRAWING

In the drawing,

FIG. 1 is a schematic illustration of a prior art microwave switch;

FIG. 2 is a schematic illustration in perspective of a single-pole, single throw, microwave switch constructed in accordance with the invention;

DESCRIPTION OF THE PREFERRED EMBODIMENT

Figure 3:
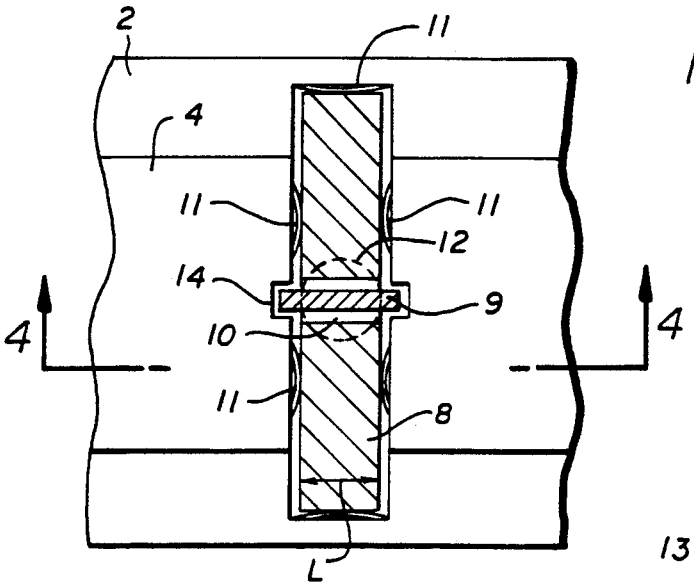
FIG. 3 is a fragmentary top view, in schematic, of the switch illustrated in FIG. 2.

FIG. 2 is a schematic illustration in perspective of a microwave switch constructed in accordance with the invention. The switch comprises a grounded, metal waveguide cavity-defining enclosure 4. As is known to those skilled in the art, the waveguide cavity is typically grounded by either mounting the enclosure on a ground plane, or by grounding the enclosure via one of the conductors in the external coaxial cable carrying the signal to and/or from the switch. Although "ground" is typically 0 volts (d.c.), which will therefore be assumed as "ground" for the purpose of this description, the reader should recognize that any fixed or floating d.c. level may naturally be designated as "ground" for a particular system application.

Within the waveguide cavity is a microstrip substrate 1 which is grounded on its bottom by a supporting bottom plate 2. The substrate 1 carries a top metal surface which is divided into two segments 6, 7 by a slot 5 which extends downward through the substrate. As will be seen, the metal surface segments 6, 7 carry the electrical signal to be transmitted through the switch. The illustrated switch has input and output terminal means respectively connected to the segment 6 and segment 7. The terminal means may be, for example, conventional coaxial connectors or may be provided by areas of the segments to which external components are directly connected.

The substrate 1 and metal surface segments 6, 7 are completely surrounded on all sides by the grounded metal enclosure 4. Because no transmitted signal can escape the housing, the configuration thus far can conveniently be referred to as an "Enclosed Microstrip Transmission Line". The microstrip substrate is made from a suitable microwave substrate material, such as alumina, which is a very hard and brittle material. Alternatively, a softer microwave-clad material such as a PTFE-based material can be used. These materials are made with high precision and tight tolerances at very reasonable costs by, and are readily available from, many manufacturers.

As is known in the art, the characteristic impedance of the enclosed microstrip transmission line is primarily determined by (a) the dielectric constant $E_r$ of the substrate material (typically in the range of 2.2 to 10.5), (b) the width $W_1$ of the top metalization layer on the substrate material, and (c) the thickness $T_1$ of the microstrip substrate material. All of these factors are easily controlled during manufacture. To a lesser extent, the characteristic impedance of the transmission line is also known to be affected by the cavity width $W_2$, cavity height Z, metal thickness $T_2$ and substrate material width (which is the same as the cavity width). As is also known to those skilled in the art, the cavity dimensions are chosen so that no higher order modes are excited over the range of operating frequencies of interest.

The gap 5, illustrated in FIG. 2 as interrupting the signal-carrying path into two path segments 6, 7, may separate those segments by as little as approximately 0.01 inches. Although no current can cross the gap 5 at low frequencies, those skilled in the art will recognize that the fringe capacitance $C_f$ across the gap 5 couples some signal across the gap at higher frequencies, and is therefore particularly troublesome as an isolation-degrading phenomenon at microwave frequencies.

To provide the switching function in the switch, a switch member in the form of a blade assembly 13 is positioned in the air gap 5. The dimensions of the blade assembly 13 are such that it extends completely across the waveguide cavity in both dimensions perpendicular to the direction of the microstrip at the air gap. The reader will appreciate that when the segment of the blade assembly in the gap is electrically conductive and is grounded, the coupling field between the two microstrip segments 6, 7 is completely interrupted, the fringe capacitance $C_f$ falls to zero, and no coupling exists between the two microstrip segments 6, 7. Consequently, the two segments are highly isolated, and the isolation characteristic of the switch (which is the most difficult and crucial requirement) is extremely high, even at microwave frequencies.

Closing the switch is relatively simple. When the segment of the blade assembly in the gap 5 electrically couples the microstrip segments 6, 7 together by, for example, physically bridging the gap 5 with an electrically conductive element, the switch is closed. The switch herein is accordingly based upon the foregoing principle of operation.

Figure 4:
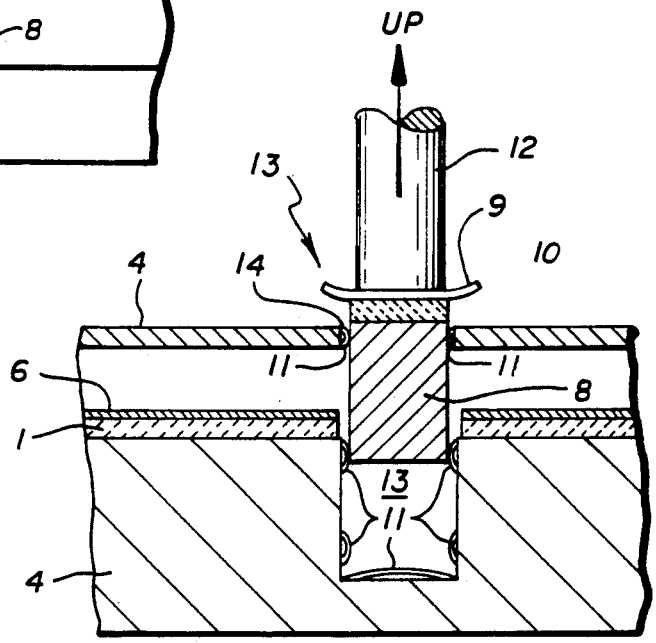
FIG. 4 is a schematic illustration of the switch of FIG. 3 in section taken along line 4—4, and showing the position of the switch member 13 when the switch is open.
Figure 5:
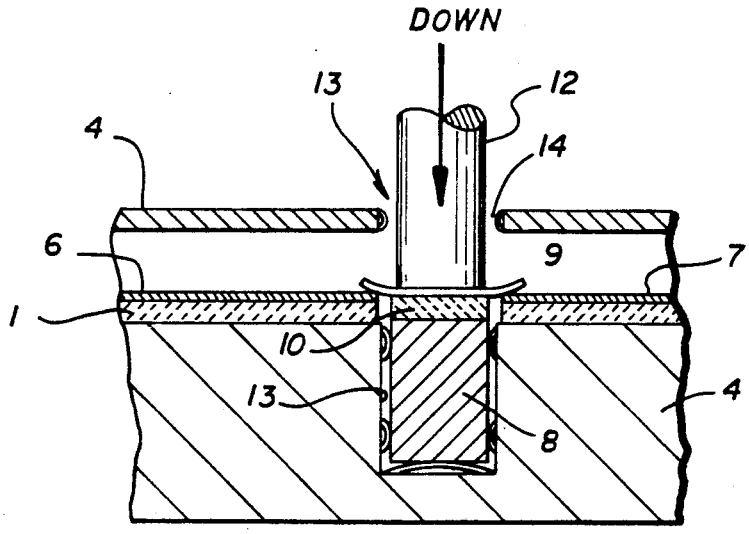
FIG. 5 is a schematic illustration similar to FIG. 4, but showing the position of the switch member 13 when the switch is closed.

Turning to FIGS. 3-5, the operation of the switch will be more fully explained. FIG. 3 is a top fragmentary view, in schematic, of a switch constructed in accordance with the invention. FIG. 4 is a schematic illustration of the switch of FIG. 3 in section taken along line 4—4, and showing the position of the blade assembly 13 when the switch is open. FIG. 5 is a schematic illustration similar to FIG. 4, but showing the position of the blade assembly 13 when the switch is closed. As shown in FIG. 3-5, the blade assembly 13 is mounted at the distal end of an insulating plunger 12 which can conveniently be reciprocally moved upward and downward by a solenoid arrangement (not shown). The blade assembly 13 includes a first electrically conductive segment 8 and a second electrically conductive segment 9 separated by an electrically non-conducting layer of material 10.

The second electrically conductive segment 9 is in the form of a cantilevered, springy, electrically conductive element which extends outwardly from the plunger 12 to make overlying contact with the microstrip segments 6, 7 on either side of the gap when the plunger 12 is moved downward to close the switch. (FIG. 5). Naturally, other structures which are either physically attached to, integral with, or operatively associated with the plunger may be substituted for the disclosed element without departing from the spirit of the invention.

The first electrically conductive segment 8 of the blade assembly, which isolates the microstrip segments when positioned in the gap, is always electrically coupled to the waveguide cavity enclosure, and therefore to ground, via sliding contact with a plurality of contacting springs 11. This is so both when the switch is open (FIG. 4) and when the switch is closed (FIG. 5). When the switch is open (FIG. 4), the grounded first segment 8 fills the air gap between the microstrip segments 6, 7 and extends upward through a slot 14 formed in the upper wall of the waveguide cavity enclosure 4 totally filling the space between the two segments 6-7 that could accommodate a gap-crossing capacitive field. Thus., any such field is thereby shunted to ground and all capacitive fields between the two segments 6, 7 in the cavity are eliminated.

The slot 14 is also dimensioned to permit the cantilevered, electrically conductive spring member 9 to move upward out of the waveguide cavity when the switch is open (FIG. 4), and is provided in the preferred embodiment with a complimentary rectangular shape for that reason, as best seen in FIG. 3. The slot 14 accordingly permits the passage of the spring member 9 in and out of the cavity as the plunger is moved up and down to open and close the switch.

When the plunger 12 is moved downward to close the switch (FIG. 5) to bring the opposite ends of the springy electrically conductive member 9 into overlying contact with the opposing ends of the microstrip segments, the first electrically conductive segment 8 of the blade assembly is pushed below the microstrip into a slot 13 formed in the lower surface of grounded enclosure and remains connected to ground via the sliding contact with contact springs 11 positioned in the slot 13.

The plunger 12 is moved vertically by a solenoid arrangement in a manner known in the art. Specifically, the plunger extends up into the bobbin housing of the solenoid coil (not shown). When the solenoid is activated by passing current through the coil, the plunger is forced downward until the conductive spring member 9 contacts and electrically connects the microstrip segments 6, 7 thereby closing the switch. When, on the other hand, no current passes through the solenoid coil, the plunger is urged upward by a retracting spring arrangement (not shown) to open the switch.

Figure 6:
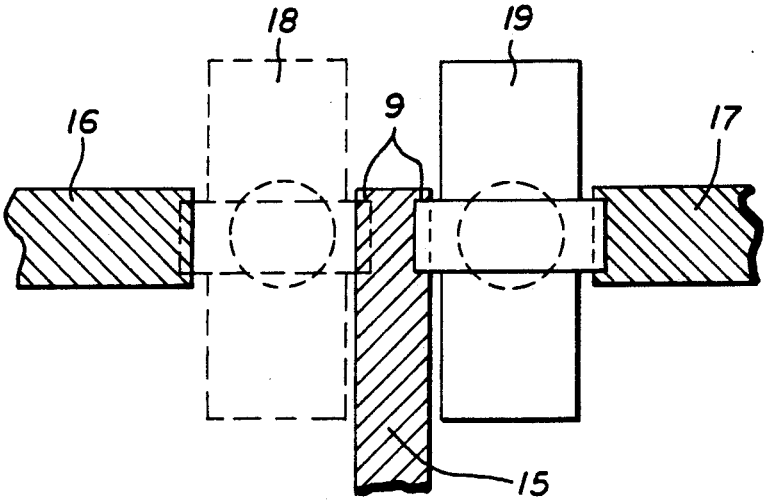
FIG. 6 is a fragmentary top view, in schematic, of a single-pole, double throw switch arrangement constructed in accordance with the invention.
Figure 7:
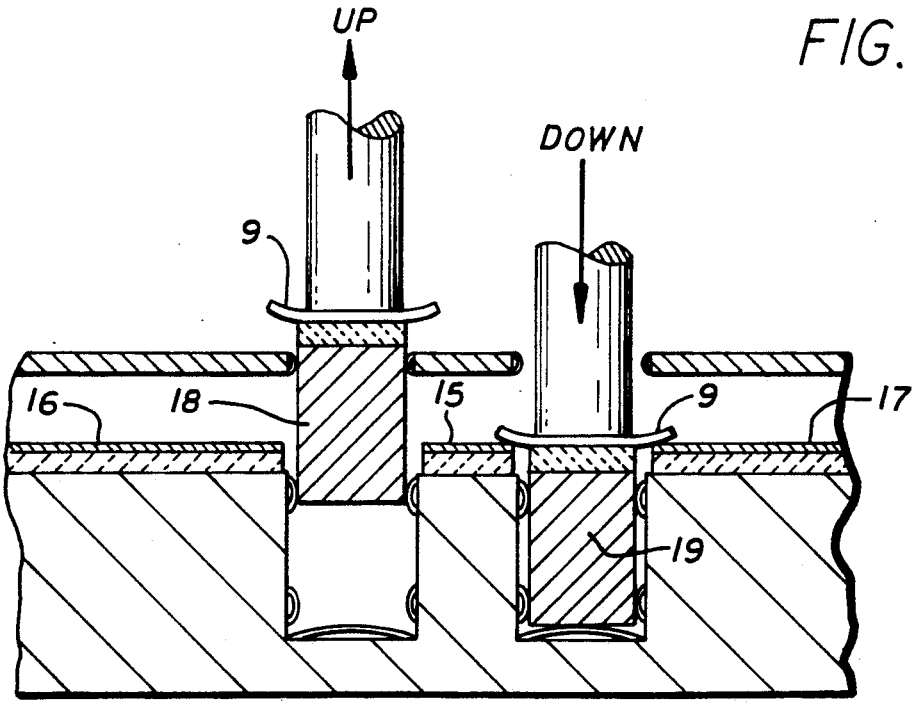
FIG. 7 is a schematic sectional side view of the switch of FIG. 6.

Those skilled in the art will recognize that the single-pole, single throw structure described above may be easily adapted to other switching arrangements such as the more common single-pole, double throw (SPDT) arrangement. FIG. 6 is a fragmentary top view, in schematic, of an SPDT switch constructed in accordance with the invention, while FIG. 7 is a side view. The major difference between this arrangement and that illustrated in FIG. 3 of an SPST configuration is that the SPDT switch includes three microstrip segments and two switching elements.

As shown in FIG. 6, the SPDT switch includes an input microstrip 15, two output microstrips 16, 17 and two switch elements 18, 19. The switch element 18 is shown in the open configuration, while the right switch member 19 is in the closed position.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. A microwave switch comprising:

a waveguide cavity-defining enclosure;

input and output terminal means;

conducting means including an electrically conductive path of material within the waveguide cavity and electrically coupled to the input and output terminal means at its opposite ends so that the input and output terminal means can respectively electrically connect input and output electrical components to the path of material, the conducting means further including a path-interrupting gap;

a switching member movable within the gap between closed and open positions, the switching member including a first electrically conductive segment electrically connected to the enclosure and positionable within the gap when the switching member is in the open position to interrupt any capacitive coupling field otherwise bridging the gap to thereby provide a substantially open circuit between the input and output terminal means;

a second electrically conductive segment carried by the switching member in electrical isolation from the first segment for completing the path between the input and output terminal means when the switching member is in the closed position; and means for selectively moving the switch member to the open and closed positions.

2. The switch of claim 1 wherein the switching member further includes an electrically non-conductive segment between the first and second electrically conductive segments.

3. The switch of claim 2 wherein the second segment includes means for electrically completing the path by physically bridging the gap to contact the path on both sides of the gap.

4. The switch of claim 2 wherein the second segment includes an electrically conductive, generally cantilevered member movable with the first segment of the switch member, and extending outward from the switch member to make overlying contact with the path on both sides of the gap when the switch member is in the closed position.

5. The switch of claim 1 wherein the electrically conductive path is defined by a microstrip including a substrate and an electrically conductive layer of material supported by the substrate.

6. The switch of claim 5 wherein the cavity enclosure includes a slot underlying the gap and dimensioned to receive the first segment of the switch member when the switch member is in the closed position.

7. The switch of claim 1 including contacting spring means positioned for sliding contact with at least one of the first electrically conductive segment and the waveguide cavity enclosure to electrically couple said segment and cavity enclosure.

8. The switch of claim 7 wherein the contacting spring means is positioned to electrically couple said first segment and cavity enclosure in both the open and closed switch positions.

9. The switch of claim 8 wherein the cavity enclosure includes a slot underlying the gap and dimensioned to receive the first segment of the switch member when the switch member is in the closed position.

10. The switch of claim 9 wherein the contacting spring means includes a plurality of contacting springs positioned in the substrate slot to make sliding contact with the first segment of the switch member so that the first segment is electrically grounded to the waveguide enclosure in substantially all positions during operation of the switch.

11. A microwave switch comprising:

a waveguide cavity-defining enclosure;

input and output terminal means;

an electrically conductive strip of material within the waveguide cavity and extending between the input and output terminal means to generally define an electrical path between the input and output terminal means, the strip of material including a path-interrrupting gap;

a coupling member reciprocally movable between open and closed positions within the gap along an axially directed path, the member including a first electrically conductive segment electrically connected to the enclosure and positionable to lie within the gap when the member is in the open position to interrupt any coupling field bridging the gap and to thereby provide a substantially open circuit between the input and output terminal means;

a second electrically conductive segment mounted on the coupling member for reciprocal movement therewith and electrically isolated from the first segment for completing the path between the input and output terminal means when the member is in the closed position.

12. The switch of claim 11 wherein the second segment is electrically isolated from the first segment.

13. The switch of claim 12 wherein the second segment is axially spaced from the first segment.

14. A microwave switch comprising:

a waveguide cavity-defining enclosure;

input terminal means;

a pair of output terminal means;

an electrically conductive input path of material within the waveguide cavity electrically coupled to the input terminal means;

a pair of electrically conductive output paths of material within the waveguide cavity having respective proximate and distal end regions, the distal end regions of each output path being electrically coupled to a respective output terminal means, the proximate end regions of each output path being separated from the input path by a respective gap;

a pair of switching surface members respectively movable within the gaps between respective closed and open positions, each switching surface member including (1) a first electrically conductive segment electrically connected to the enclosure and positionable within the respective gap when the switching surface member is in the open position to interrupt any capacitive coupling field otherwise bridging the gap to thereby provide a substantially open circuit between the input and respective output terminal means, and (2) a second electrically conductive segment carried by the switching surface member and electrically isolated from the respective first segment for completing the path between the input and respective output terminal means when the switching member is in the closed position; and means for opposingly moving the switching surface members between respective open and closed positions so that only a selected one of the two output terminal means is electrically coupled to the input terminal means, thereby providing a double throw switch arrangement.

15. A microwave switch comprising:

a waveguide cavity-defining enclosure;

input and output terminal means;

conducting means including a pair of electrically conductive microstrips within the waveguide cavity respectively electrically coupled to the input and output terminal means and separated from each other by a gap a blade member movable within the gap between closed and open positions, the blade member including (1) a first electrically conductive segment electrically connected to the enclosure and positionable within the gap to define the to interrupt any capacitive coupling field otherwise bridging the gap, thereby providing a substantially open circuit between the input and output terminal means, and (2) a second electrically conductive segment carried by the blade member in electrical isolation from the first segment, and extending outward from the blade member to bridge the gap in said closed position, to thereby complete the path between the input and output terminal; and means for selectively moving the blade member to the open and closed positions.

16. The switch of claim 15 wherein the first electrically conductive segment substantially fills the space between the microstrips that could accommodate a gap-crossing capacitive field between the microstrips.

17. The switch of claim 15 wherein the waveguide enclosure includes a slot in one wall dimensioned to permit passage of at least a portion of the first electrically conductive segment, the first segment thereby extending through the enclosure wall when in the open position to substantially fill the space between the microstrips.

18. The switch of claim 15 including sliding contact means for maintaining electrical coupling between the first electrically conductive segment and the waveguide enclosure.

19. The switch of claim 15 wherein the second electrically conductive segment is a cantilevered, springy element extending outward from the blade member.

20. The switch of claim 15 wherein the waveguide enclosure includes a slot dimensioned to permit the second electrically conductive segment to pass out of the cavity when the blade is in the open position.

21. The switch of claim 15 wherein the blade member includes and electrically non-conductive segment separating the first and second electrically conductive segment segments.

* * * * *